US006315944B1

(12) United States Patent
Iversen et al.

(10) Patent No.: US 6,315,944 B1
(45) Date of Patent: Nov. 13, 2001

(54) PLANT FOR CASTING METAL WITH PARTICLES SUSPENDED THEREIN

(75) Inventors: Peter Møller Iversen, Brønshøj; Uffe Andersen, Skævinge, both of (DK)

(73) Assignee: Georg Fischer Disa A/S, Herlev (DK)

( * ) Notice: Subject to any disclaimer, the term of this patent is extended or adjusted under 35 U.S.C. 154(b) by 0 days.

(21) Appl. No.: 09/486,387

(22) PCT Filed: Aug. 24, 1998

(86) PCT No.: PCT/DK98/00364

§ 371 Date: Feb. 28, 2000

§ 102(e) Date: Feb. 28, 2000

(87) PCT Pub. No.: WO99/11833

PCT Pub. Date: Mar. 11, 1999

(30) Foreign Application Priority Data

Sep. 2, 1997 (EP) ..... 97115151

(51) Int. Cl.[7] ..... B22D 35/04

(52) U.S. Cl. ..... 266/235; 75/684; 75/708; 164/98; 164/312

(58) Field of Search ..... 164/312, 98; 266/235; 75/708, 684

(56) References Cited

U.S. PATENT DOCUMENTS 5,524,699 * 6/1996 Cook ..... 164/97
5,531,425 * 7/1996 Skibo et al. ..... 266/235

* cited by examiner

*Primary Examiner*—Melvyn Andrews
(74) *Attorney, Agent, or Firm*—Larson & Taylor PLC

(57) ABSTRACT

Molten metal (6) in a furnace (5) and containing particles of solid material (not shown) in suspension is cast in moulds (1) conveyed continuously past the mould-filling station shown by a conveyor (4). To maintain the particles in suspension and keep the metal (6) homogeneous throughout the furnace (5), a paddle-wheel rotor (10) driven by a motor (13) keeps the molten metal in constant movement. A curved guide vane (14) is shaped, placed and oriented so as to divert some of the centrifugal flow from the rotor (10) towards the delivery tube (8) for the moulds (1), thus ensuring that the tube (8) is supplied with freshly-agitated metal.

7 Claims, 1 Drawing Sheet

PLANT FOR CASTING METAL WITH PARTICLES SUSPENDED THEREIN

TECHNICAL FIELD

The present invention relates to a method of the kind set forth in the preamble of claim 1.

BACKGROUND ART

In methods of this kind, it is known to cast so-called metal matrix composite materials (MMC) in a batch-wise manner, i.e. preparing a batch of the mixture of molten metal and solid particles in a suitable furnace, from which the mixture is transferred to the moulds by means of ladles. Apart from the low rate of production as compared to modern mass-production casting, the known method suffers from the disadvantage that the solid particles tend to sink to the bottom of the furnace, as they are usually heavier than the metal. This will obviously imply a risk of differences in the concentration of particles from one casting to the next.

DISCLOSURE OF THE INVENTION

It is the object of the present invention to provide a method of the kind referred to above, with which it is possible to produce castings with a uniform concentration of particles at a high rate of production, and this object is achieved with a method of said kind, according to the present invention also comprising the features set forth below. By proceeding in this manner, the concentration of particles in the molten metal is kept constant, at the same time as the filling of the moulds is carried out at a rate consistent with modern methods of mass production.

The present invention also relates to a plant for carrying out the method according to the invention. This plant is of the kind set forth below, and according to the invention, it also comprises the features set forth below.

Advantageous embodiments of the method and the plant according to the invention, the effects of which—beyond what is obvious—will be evident from the following detailed part of the present description, are set forth hereinafter, respectively.

BRIEF DESCRIPTION OF THE DRAWINGS

In the following detailed part of the present description, the invention will be explained in more detail with reference to the exemplary embodiment of a plant according to the invention shown in the drawings, in which.

The remaining parts of the plant, that will be well-known to persons skilled in this field, are not shown, this not being necessary for the understanding of the invention.

DESCRIPTION OF THE PREFERRED EMBODIMENT

Figure 1:
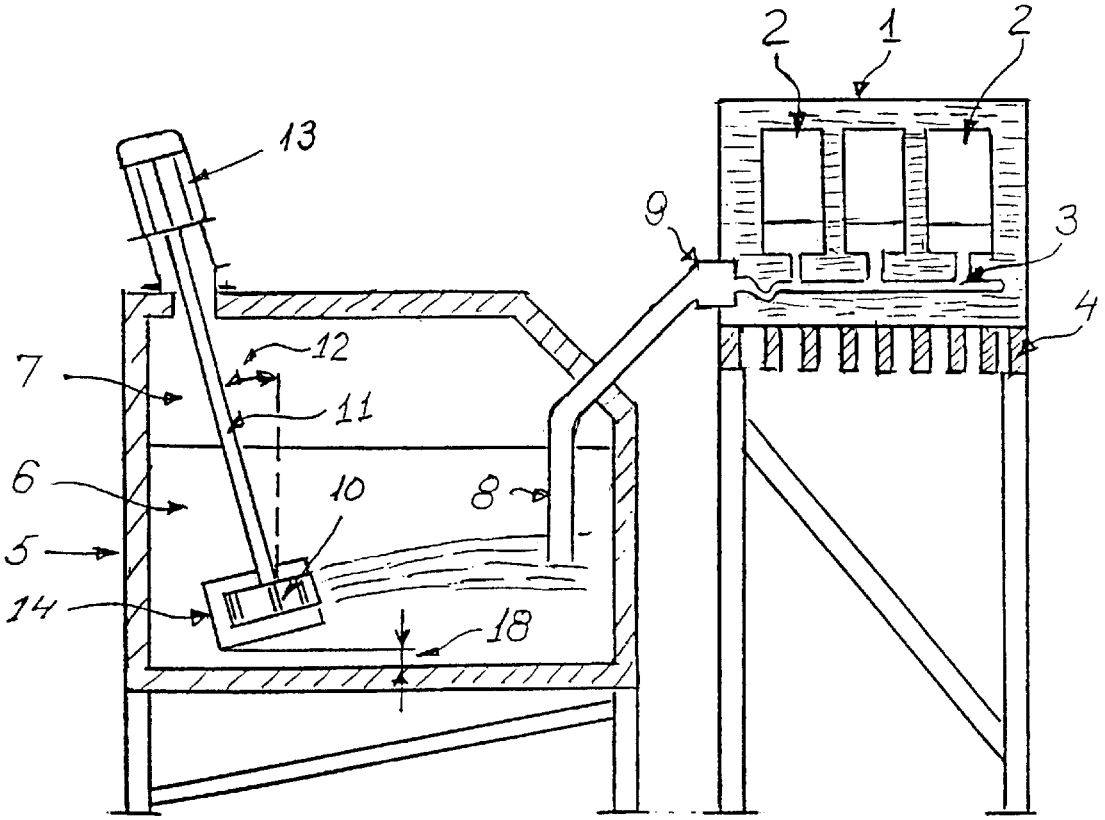
FIG. 1 shows an exemplary embodiment of a mould-filling station comprising a mould-filling station comprising a mould-filling furnace adapted to fill casting cavities in moulds comprised by a mould string advanced on a conveyor.

The mould-filling station shown in FIG. 1 accommodates a mould 1, in the example shown having three identically shaped casting cavities 2, the lowermost parts of which communicate with a common filling duct 3.

The mould 1 is one of a number of similar moulds being advanced by a conveyor 4 in a direction transverse to the plane of the drawing in the form of a "string" of moulds.

A mould-filling furnace 5 contains a quantity of molten metal 6, to be described in more detail below, being acted upon by the pressure of a gas, that may be compressed air, in an upper space 7. When a mould 1 is to be filled with molten metal, the pressure in the upper space 7 is increased so as to cause the metal to flow upwardly through a delivery tube 8 having a spout 9 temporarily communicating with the common filling duct 3, so that metal will flow into the casting cavities 2 and ascend to the uppermost limits of the latter.

The mould-filling furnace 5 and the filling tube 8 with the spout 9 are, of course, suitably heated and/or thermally insulated to keep the metal in them in the molten state. The requisite means for heating and/or insulation are not shown, but any person with a knowledge of furnace and foundry practice will know how to provide them, for which reason they will not be described in the present description.

When using the equipment shown in the drawing for carrying out the method according to the present invention, the molten metal 6 is in fact a mixture of a molten metal, such as aluminium or an aluminium-containing alloy, and particles of solid material, such as silicon carbide (SiC). These particles have been added to increase the wear resistance as well as to enhance the friction characteristics of the castings, e.g. in the form of brake blocks for disk brakes.

The specific gravity of molten aluminium is 2.5, whereas the specific gravity of silicon carbide lies in the range 3.2–3.6. Obviously, the silicon carbides particles will tend to sink to the bottom of the mould-filling furnace 5, unless precautions are taken to prevent this.

In order to keep the particles in suspension in the molten metal 6, the mould-filling furnace is equipped with agitating means, in the exemplary embodiment shown comprising

- a paddle-wheel rotor 10 placed close to the bottom of the furnace 5 and secured to
- a shaft 11 extending upwardly at an angle 12 with the vertical to
- a drive motor 13, such as an electric motor, and
- a stationary guide vane 14 placed close to the rotor 10 in a manner to be described below.

In operation, i.e. when rotating in the direction shown by the arrow 15, the rotor 10 functions substantially in the same manner as e.g. the stirrers used to stir paint or emulsions in the food-processing industry, i.e. it will draw liquid in at its centre and throw it radially outwards in all directions. Due to the presence and particular shape and position of the guide vane 14, some of the liquid—i.e. molten metal with particles suspended therein—will, however, be directed towards the delivery tube 8, thus constantly supplying the latter with freshly stirred metal.

Figure 2:
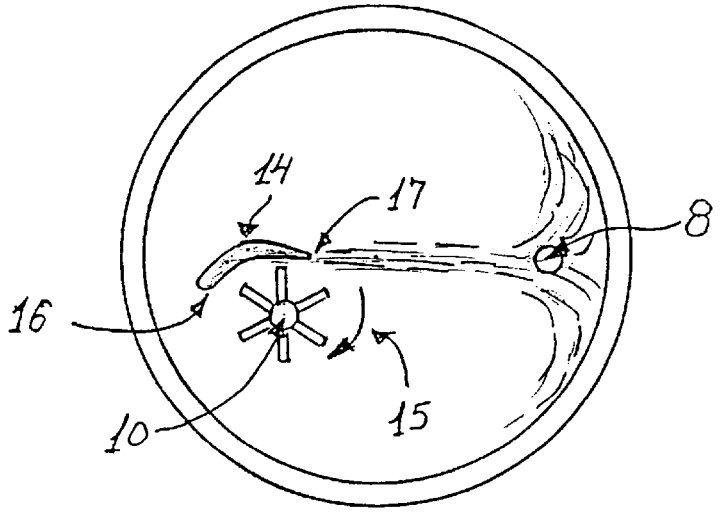
FIG. 2 is a sectional view taken along the line II—II in FIG. 1.

As may be seen from FIG. 2, the inflow end 16 of the guide vane 14 lies roughly opposite to the delivery tube 8 on the "rear" side of the rotor 10 and at some distance from the latter, while the outflow end 17 lies quite close to the rotor 10 in a position, in which the latter's paddles move in a direction towards the delivery tube 8, thus causing the effect described above.

In the exemplary embodiment shown, the angle 12 is approximately 20°, but the arrangement will function satisfactorily with an angle 12 in the range 0–90°.

Obviously, the rotor 10 and the guide vane 14 will have to be made from material capable of withstanding both the high temperatures encountered and any possible corrosive effect of the molten metal 6, as well as any possible abrasive effect of the particles of e.g. SiC suspended in the molten metals. Preferably, the materials used for the rotor 10 and the guide vane 14 as well as for the associated parts should be such that are not wetted by the molten metal being worked with. In an embodiment having been tried in practice, the rotor 10 was made of graphite, while the guide vane 14 was made in the following manner: A segment corresponding to the desired profile for the guide vane is cut from an insulating and heat-resistant material, such as a piece of "ISO" tube fabricated from ceramic wool. The guide vane is then reinforced by impregnating it with a heat-resistant adhesive containing ceramic wool, such as "FIBERFRAX". Finally, it is coated with boron nitride to avoid it being wetted by the molten metal.

Obviously, the stationary guide vane 14 will have to be supported in a manner to keep it in the position described above. The means for this are not shown, but could e.g. be one or two rods secured to a pivotable bracket also carrying the motor 13, so that an adjustment of the angle 12 would not change the position of the guide vane 14 relative to the rotor 10.

In an embodiment not shown, the paddle-wheel rotor 10 is replaced by a propeller-like impeller or axial-flow impeller, and the guide vane 14 by a similarly curved guide vane placed above or below the impeller to deflect some of its outflow towards the delivery tube 8. Other solutions are, of course, possible, provided that they provide both the vigorous circulation to keep the solid particles in suspension and the direct flow of freshly agitated mixture towards the delivery tube 8.

The rotor 10 or the similar device may be rotated at a speed with a wide range. However, if a laminar flow is to be obtained a rotational speed of app. 150 to 200 rpm has proved to be suitable.

To allow for adjustment of the angle 12, there should be an adequate clearance 18 to prevent the rotor 10 and the guide vane 14 from coming into contact with the bottom of the furnace 5.

LIST OF PARTS

1 mould
2 casting cavity
3 filling duct
4 conveyor
5 mould-filling furnace
6 molten metal
7 upper space
8 delivery tube
9 spout
10 paddle-wheel rotor
11 shaft
12 angle
13 drive motor
14 guide vane
15 arrow
16 inflow end
17 outflow end
18 clearance

What is claimed is:

1. In a plant for casting metal matrix composites in moulds, said plant comprising:

a) a furnace including a molten-metal space adapted to contain molten metal, b) supporting means for temporarily supporting at least one mould in a position close to said furnace, and c) transfer means for transferring molten metal from said furnace to said at least one mould while in said position, and d) agitating means placed in the molten-metal space of said furnace and adapted to agitate said molten metal so as to keep solid particles therein uniformly distributed, the improvement wherein said agitating means includes guide means for directing at least part of a newly agitated mixture produced by said agitating means to said transfer means, and said transfer means comprises a delivery tube extending into said molten-metal space and adapted for communication with a filling duct for the moulds.

2. A plant according to claim 1, wherein said agitating means comprises a rotor secured to the lower end of a shaft, and the upper end of the shaft is secured to the output shaft of a motor, and wherein said guide means of said agitating means comprising an arcuate guide vane secured in a position adjacent one side of said rotor such that rotation of said rotor causes movement of said at least part of the newly agitated mixture towards said transfer means, said arcuate guide vane having an inflow end disposed at a relatively large distance from a side of said rotor facing away from said transfer means and an outflow end disposed at a relatively small distance from a side of the rotor facing towards the transfer means.

3. A plant according to claim 1 wherein said agitating means comprises an axial-flow impeller producing an outflow and being secured to a lower end of a shaft, said shaft having an upper end secured to an output shaft of a motor, and said guide means of said agitating means including a guide vane so shaped and arranged to as to direct part of the outflow from said axial-flow impeller towards said transfer means.

4. A plant according to claim 3, wherein said shaft forms an angle of from 0° to 90° with the vertical direction.

5. A plant according to claim 2, wherein said motor provides rotation of the agitating means at a speed of approximately 150–200 rpm.

6. A plant according to claim 1, wherein the solid particles have a specific gravity of substantially the same order as the specific gravity of the molten metal or slightly above this level.

7. A plant according to claim 2 wherein said rotor comprises a paddle-wheel.

* * * * *